United States Patent [19]

Cosmopulos

[11] 4,225,139

[45] Sep. 30, 1980

[54] DOMINO TYPE GAME APPARATUS

[76] Inventor: Stavros Cosmopulos, 8 Bridge St., Norwell, Mass. 02061

[21] Appl. No.: 956,888

[22] Filed: Nov. 2, 1978

[51] Int. Cl.[3] ..... A63F 9/20

[52] U.S. Cl. ..... 273/294

[58] Field of Search ..... 273/292, 294; 35/72

[56] References Cited

U.S. PATENT DOCUMENTS 2,782,039 2/1957 Martin ..... 273/292

FOREIGN PATENT DOCUMENTS 920351 1/1947 France ..... 273/294

1408344 7/1965 France ..... 273/294

*Primary Examiner*—Anton O. Oechsle

*Attorney, Agent, or Firm*—Morse, Altman, Oates & Bello

[57] ABSTRACT

Game pieces comprised of three legged tiles are provided for use in a domino-type game. A set of tiles is utilized for the game, each set comprised of a number of three legged tiles most of which are marked with different numerical indicia in the form of spots as well as in Arabic numerals. Each tile is a generally flat piece with three legs extending radially from a center portion of equal angular distances one from the other. The outer end face of each leg is flat and each leg terminates at its inner end in a flat face near the center juncture joining adjacent legs. Tiles are connected by abutting the end of one leg of one tile with the end of a leg of another tile or by joining the end of one leg with the flat junction face of another tile in accordance with the rules of the game. The tiles can be connected in different geometric patterns including circles.

6 Claims, 11 Drawing Figures

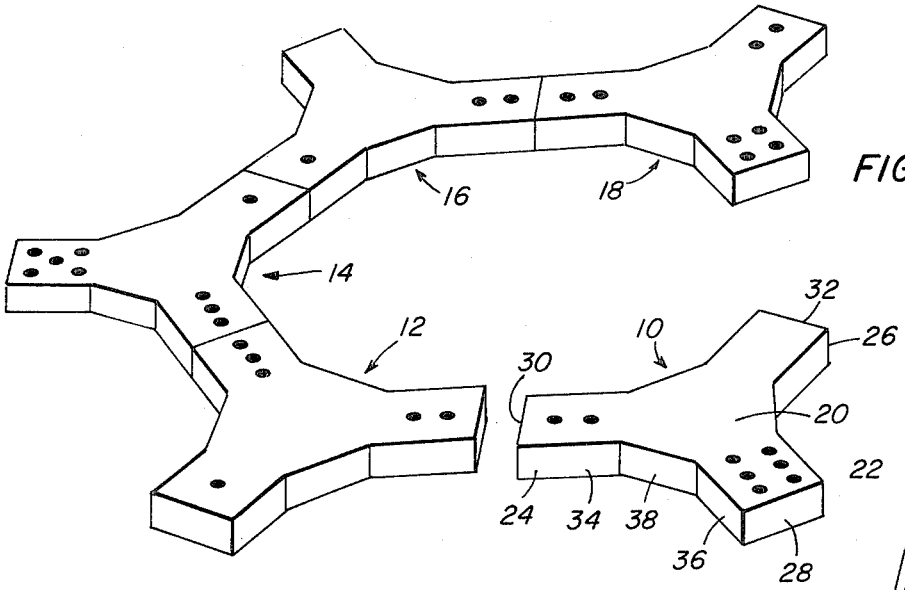
FIG. 1
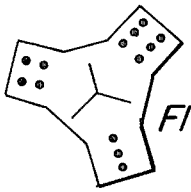
FIG. 9
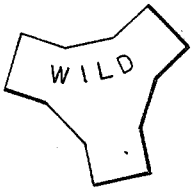
FIG. 11
FIG. 10
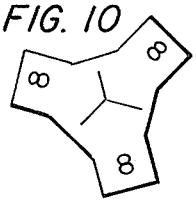
FIG. 7
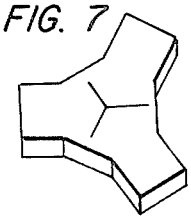
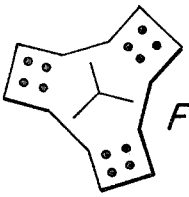
FIG. 8
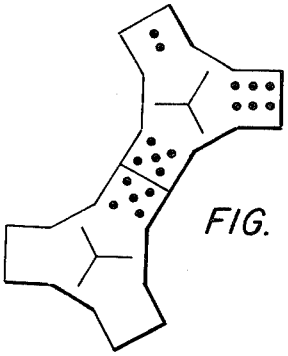
FIG. 4
FIG. 5
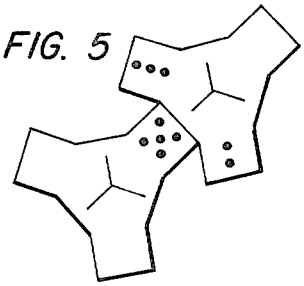
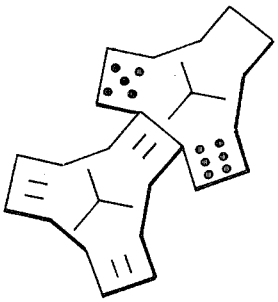
FIG. 6
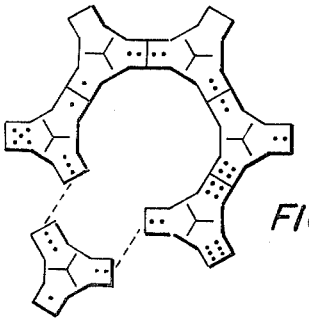
FIG. 2
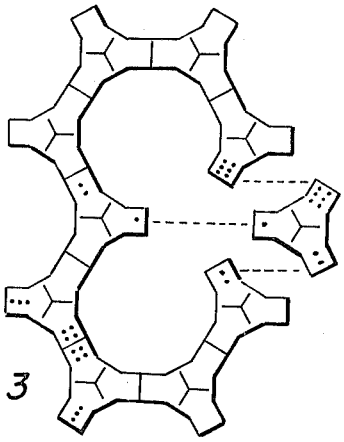
FIG. 3

DOMINO TYPE GAME APPARATUS

BACKGROUND OF THE INVENTION

1. Field of the Invention

This invention is related generally to games and more particularly is directed towards a new and improved domino type game involving three legged tile pieces connectable in a variety of different and unusual arrangements.

2. Description of the Prior Art

The game of dominoes has been around for a great many years and, as is well known, involves the use of rectangular tiles which bear markings, typically in the form of one or more spots in groups at each end of the tiles. The game is played by joining one tile to another by matching similarly marked tile ends. The game is limited to a specific geometric configuration namely straight rows of tiles laid end-to-end or extending out at right angles according to available matching tile segments. Thus, after a while the players tend to loose interest in the game because the number of possible combinations is limited.

Accordingly, it is an object of the present invention to provide improvements in domino type games and related apparatus.

Another object of this invention is to provide novel domino type tiles having an increased number of matching portions providing a greater number of combinations and arrangements of the tiles in a variety of different patterns.

SUMMARY OF THE INVENTION

This invention features tile pieces for use in a domino-type game, comprising a plurality of individual tiles, each tile being formed with three radially extending and angularly spaced legs terminating in flat outer ends and formed with outwardly facing flat faces at the juncture between each pair of adjacent legs, each leg of most tiles being marked with a numerical indicia. The game is played by matching similarly marked legs and placing them end-to-end or by placing a leg against a junction according to the rules of the game. Tiles joined in this fashion form a variety of different geometric patterns which include open and closed circles.

BRIEF DESCRIPTION OF THE DRAWINGS

FIG. 1 is a view in perspective of a group of tiles made according to the invention in a typical playing pattern, FIG. 2, 3 are top plan views showing single and double circle patterns, typically created during the play of a game, FIGS. 4, 5 and 6 are top plan views showing typical mating positions of tile pairs, FIG. 7 is a view in perspective showing a blank tile used as a part of the game set, FIGS. 8 through 11 are top plan views showing several different selected tile pieces employed in the game.

DETAILED DESCRIPTION OF THE PREFERRED EMBODIMENT

Referring now to the drawings and to FIG. 1 in particular, the reference character 10 generally indicates one tile of a group of similar tiles 12, 14, 16 and 18 arranged in a generally circular pattern such as that which typically may be formed during the play of a game. All tiles are the same size and configuration although each bears a distinctive marking or no marking at all, as will be disclosed more fully below.

Each tile is characterized by a center or hub portion 20 from which extend three legs 22, 24 and 26, all of the same length and arranged in at equal angular distances to each adjacent leg. Each leg is angularly spaced 120° from an adjacent leg and has a length from the center of the tile to the leg end of 1½" reulting in an overall diameter of each tile approximately 2¼". The width of each leg typically is approximately ⅝". These dimensions are not critical but only by way of an example of a tile size that is convenient for playing purposes. Obviously, the sizes may be altered as desired. Each tile is flat and relatively thick for ease of gripping and moving the tile as well as for standing it on edge, for reasons that will presently appear. The tile thickness may be varied, but for a tile of the above dimension a thickness or perhaps ¼" to ½" has been found satisfactory.

The tiles may be fabricated from a variety of materials such as rigid plstics that may be easily injection molded or cast, or shaped from wood, glass or even metal. In any event each leg of each tile terminates in a flat outer face 28, 30 and 32 at the end thereof with the sides of each leg also defining flat faces 34, 36 etc. each of a size substantially equal to that of each outer face. At the junction between the inner ends of each leg joining the side faces 34 and 36 there is formed a flat junction face 38 on the center portion 20. The size of each junction face 38 is substantially equal to the width of the end face 28 of each leg as well as to each side face 34, 36 by means of which each leg end face may mate against a junction face 38 in the manner suggested in FIG. 5, for example, or against a side face 34, 36.

Each tile, therefore, has twelve functional faces that may be used in the play of the game. These are the three outer faces, one at the end of each leg, the three inner junction faces against which an end face may abut under the rules of the game and the six side faces 34, 36 etc. Each leg bears a set of spots from one to six or is blank. A triple tile is one that has the same number of spots on each leg such as a set of six spots on each leg or a set of five spots on each leg.

In the play of the game, the set of spots on the leg of one tile must match the set of spots on the leg of another tile, in which case the ends of the two tiles are placed one against the other in the manner shown in the FIG. 4, for example. In order to place a leg end against a junction face; such as shown in FIG. 5, the spots on the two legs forming the junction are added up and another tile is selected which has a leg bearing a number of dots equalling the total of the two legs of the first tile and is placed against the junction. In the event that the total of the two ajacent legs is greater than six, an appropriate Arabic numbered tile, all of which are triples, may be placed at the junction, as suggested in FIG. 6. The Arabic tiles are numbered 7 through 12 and, in a set of tiles, it is preferred that there be two of each tile with the same number. In the preferred play of the game, a player may not add onto or play from any of the Arabic numbered tiles once they have been played. A "wild" tile as shown in FIG. 11 may be played anywhere and would result in a score of triple the number of spots that it is placed against.

Listed below are the marking identifications for a preferred full set of tiles used in a game set. The set includes 114 tiles bearing various combinations of spots, the first two of which are entirely blank. There are twelve tiles bearing Arabic numerals, two of each number with each tile bearing the same number on each leg. Finally, there are two "wild" tiles appropriately marked.

| Spot Tiles | | | | | | | | | | | | | | | | | | | |
|---|---|---|---|---|---|---|---|---|---|---|---|---|---|---|---|---|---|---|---|
| 1 | 0 | 0 | 0 | 28 | 0 | 3 | 3 | 55 | 1 | 3 | 2 | 82 | 2 | 3 | 6 | 109 | 4 | 4 | 5 |
| 2 | 0 | 0 | 0 | 29 | 0 | 3 | 4 | 56 | 1 | 4 | 2 | 83 | 2 | 4 | 3 | 110 | 4 | 4 | 6 |
| 3 | 0 | 1 | 0 | 30 | 0 | 3 | 5 | 57 | 1 | 5 | 2 | 84 | 2 | 4 | 4 | 111 | 5 | 5 | 5 |
| 4 | 0 | 2 | 0 | 31 | 0 | 3 | 6 | 58 | 1 | 6 | 2 | 85 | 2 | 4 | 5 | 112 | 5 | 5 | 6 |
| 5 | 0 | 3 | 0 | 32 | 0 | 4 | 3 | 59 | 1 | 3 | 3 | 86 | 2 | 4 | 6 | 113 | 6 | 6 | 5 |
| 6 | 0 | 4 | 0 | 33 | 0 | 5 | 3 | 60 | 1 | 3 | 4 | 87 | 2 | 5 | 3 | 114 | 6 | 6 | 6 |
| 7 | 0 | 5 | 0 | 34 | 0 | 6 | 3 | 61 | 1 | 3 | 5 | 88 | 2 | 5 | 4 | Arabic Tiles | | | |
| 8 | 0 | 6 | 0 | 35 | 0 | 4 | 4 | 62 | 1 | 3 | 6 | 89 | 2 | 5 | 5 | 115 | 7 | 7 | 7 |
| 9 | 0 | 1 | 1 | 36 | 0 | 5 | 4 | 63 | 1 | 4 | 3 | 90 | 2 | 5 | 6 | 116 | 7 | 7 | 7 |
| 10 | 0 | 1 | 2 | 37 | 0 | 6 | 4 | 64 | 1 | 5 | 3 | 91 | 2 | 6 | 3 | 117 | 8 | 8 | 8 |
| 11 | 0 | 1 | 3 | 38 | 0 | 4 | 5 | 65 | 1 | 6 | 3 | 92 | 2 | 6 | 4 | 118 | 8 | 8 | 8 |
| 12 | 0 | 1 | 4 | 39 | 0 | 4 | 6 | 66 | 1 | 4 | 4 | 93 | 2 | 6 | 5 | 119 | 9 | 9 | 9 |
| 13 | 0 | 1 | 5 | 40 | 0 | 5 | 5 | 67 | 1 | 4 | 5 | 94 | 2 | 6 | 6 | 120 | 9 | 9 | 9 |
| 14 | 0 | 1 | 6 | 41 | 0 | 6 | 5 | 68 | 1 | 4 | 6 | 95 | 3 | 3 | 3 | 121 | 10 | 10 | 10 |
| 15 | 0 | 2 | 1 | 42 | 0 | 5 | 6 | 69 | 1 | 5 | 4 | 96 | 3 | 3 | 4 | 122 | 10 | 10 | 10 |
| 16 | 0 | 3 | 1 | 43 | 0 | 6 | 6 | 70 | 1 | 6 | 4 | 97 | 3 | 3 | 5 | 123 | 11 | 11 | 11 |
| 17 | 0 | 4 | 1 | 44 | 1 | 1 | 1 | 71 | 1 | 5 | 6 | 98 | 3 | 3 | 6 | 124 | 11 | 11 | 11 |
| 18 | 0 | 5 | 1 | 45 | 1 | 1 | 2 | 72 | 1 | 6 | 5 | 99 | 3 | 4 | 4 | 125 | 12 | 12 | 12 |
| 19 | 0 | 6 | 1 | 46 | 1 | 1 | 3 | 73 | 1 | 6 | 6 | 100 | 3 | 4 | 5 | 126 | 12 | 12 | 12 |
| 20 | 0 | 2 | 2 | 47 | 1 | 1 | 4 | 74 | 2 | 2 | 2 | 101 | 3 | 4 | 6 | No Numbers | | | |
| 21 | 0 | 2 | 3 | 48 | 1 | 1 | 5 | 75 | 2 | 2 | 3 | 102 | 3 | 5 | 4 | 127 | Wild | | |
| 22 | 0 | 2 | 4 | 49 | 1 | 1 | 6 | 76 | 2 | 2 | 4 | 103 | 3 | 5 | 5 | 128 | Wild | | |
| 23 | 0 | 2 | 5 | 50 | 1 | 2 | 2 | 77 | 2 | 2 | 5 | 104 | 3 | 5 | 6 | | | | |
| 24 | 0 | 2 | 6 | 51 | 1 | 2 | 3 | 78 | 2 | 2 | 6 | 105 | 3 | 6 | 4 | | | | |
| 25 | 0 | 4 | 2 | 52 | 1 | 2 | 4 | 79 | 2 | 3 | 3 | 106 | 3 | 6 | 5 | | | | |
| 26 | 0 | 5 | 2 | 53 | 1 | 2 | 5 | 80 | 2 | 3 | 4 | 107 | 3 | 6 | 6 | | | | |
| 27 | 0 | 3 | 2 | 54 | 1 | 2 | 6 | 81 | 2 | 3 | 5 | 108 | 4 | 4 | 4 | | | | |

The Rules Of The Game

The game may be played preferably by two to six players and all of the tiles initially are turned face down and mixed in a random fashion. Each player then withdraws seven tiles, standing them on edge so that only the player himself may see the face of each tile without any of the opponents seeing the tile faces. The player who has drawn the highest value triple tile starts the play of the game with the play moving to the left around the play area. Preferably a card table or other flat, smooth surface is used for the play of the game. If no player has drawn a triple, all tiles are returned to the pile, remixed and each player draws again. As an alternative measure, the player with the highest total spot count may start the play if no triple is drawn.

Play begins with the first player placing his triple in the center of the table and then matching a second tile to it. Thus, the play may be started with a triple such as shown in FIG. 8 where each leg has a group of four spots. The starting player may place any other tile with a four spot against any one of the legs of the first tile or he may place an Arabic numbered "8" against a junction, if he prefers. After the first player has played his first two tiles, he then draws two tiles from the pile to maintain his total number of tiles at seven. The second player then tries to match one of his tiles to an end or junction of the tiles on the table. For example, if the first player played a triple five and then matched a 5–3–2 tile to it, the second player tries to match the open ends of 2, 3 or 5. The second player may also play the junction if he has a Arabic numbered tile which, in this case a "10" may be placed in the 5—5 junction or an "8" in the 5–3 junction. If a player cannot match the ends of junctions that are open, the player must draw upon the pile until he is able to do so. Should the player draw the last tile and still not be able to play, he then passes and tries again on his next turn. A player must play a tile if able to do so.

Play continues until one player has used all of his tiles or until no one is able to play. If no further plays can be made and all tiles have been drawn, the player who has no tiles left or has the least number of points on his remaining tiles wins the round.

Scoring

The first player to use all of his tiles wins that round. The winners score is tabulated by adding up the points on his opponent's unplayed tiles. The player who wins a round by virtue of having the least number of points when no further play can be made scores all of his opponent's points less the point total of his own remaining tiles.

The Arabic numbered tiles, when played, score nothing extra, but when they are held after the round is complete, they count a face value namely, 7, 8, 9 etc.

As the tiles are played, they may form into circles such as shown in FIGS. 1, 2 and 3 and when one circle is completed, the player completing the circle is scored with three points. In the event a player completes two circles with one tile, as in FIG. 3, he is awarded ten points to his score. In the event the player is able to complete three circles with one tile, he is awarded a score of 15 points. Three circles is the maximum number of circles that can be completed with one play.

If one of the "wild" tiles is used on a regular play, it is given no extra scoring, but if it is played to complete a circle or circles, the wild tile will double the score that the player would have otherwise received. A player holding a wild tile at the end of a round results in doubling of the score in that players hand. The rounds continues until one player is able to accumulate 500 total points.

There are various modifications that may be made to the playing rules which may add to the interest of the game or shorten the time for play. For example, instead of each player keeping his tiles secret, the tiles may be laid face up in front of each player so that all players may see the tiles of every other player. Under these conditions, each player is able to try to outmaneuver his opponent by playing tiles which are intended to prevent an opponent from making plays that may score a large number of points for the opponent. Also, by removing from the play of the game all tiles with six spots as well as Arabic numbered tiles "11" and "12", the game time is shortened, particularly where there are only a few players involved in the game. The time required to play a complete game may be further reduced by removing all triple fives, as well as the Arabic tile "9" through "12".

If one player believes that an opponent is going to complete a circle or circles, he may wish to block such a move in order to prevent his opponent from scoring a large number of points. The completion of a circle may be blocked by a player by means of a junction block in which an appropriate tile is placed across one of the free ends of the partially completed circle. A junction connection of this sort is shown in FIG. 5 or 6 for example. Such a juncture block prevents the completion of the circle but penalizes the player making the block three points for blocking a single circuit, five points for blocking a double circle and seven points for blocking a triple circle. The penalty points are immediately deducted from the players score. By way of an example, assume the two remaining ends to complete a signal circle are a four spot and a one spot. To block this, the player places a tile in a junction connection in which the two ends add up to four (0–4, 1–3, 2—2) or a junction tile the ends of which add up to one (0–1). The play of the game may continue by connecting onto the blocking tile.

While the invention has been described with particular reference to the illustrated embodiment, numerous modifications thereto will appear to those skilled in the art.

Having thus described the invention, what I claim and desire to obtain by Letters Patents of the United States is:

1. Game apparatus, comprising (a) a set of tiles of similar size and shape adapted to be arranged in abutting relation according to the rules of the game, (b) each of said tiles being formed with a center portion and three radially extending co-planar legs of equal length and at an equal angular distance from one another about said center portion, (c) each of said legs terminating in a flat outer face at the end thereof perpendicular to the length of each leg and to the plane of said tile, (d) said center portion being formed with an outwardly facing flat inner face between each pair of adjacent legs and of a size substantially equal to the size of said end face, (e) each of said inner faces being perpendicular to the plane of said tile and facing in an angular direction midway between the facing directions of the outer faces of each adjacent pair of legs.

(f) each of said legs being formed with flat side faces each of a size substantially equal to the size of said end face and facing in directly opposite directions perpendicular to the facing direction of said end face, (g) the majority of said tiles bearing unique marking indicia whereby one tile may be positioned against another tile by butting an outer face of one tile selectively against one of the inner faces, the outer faces and the side faces of the other tile according to the rules of the game.

2. Game apparatus according to claim 1 wherein some of the tiles in said set bear marking indicia in the form of dots in a variety of different numbers and others of the tiles bear marking indicia in the form Arabic numerals in different denominations.

3. Game apparatus according to claims 1 wherein at least one of said tiles bears marking indicia uniquely distinct from the marking indicia of all other tiles for indicating universal use of said one tiles.

4. Game apparatus according to claim 1 wherein said tiles are flat and formed with flat upper and lower faces with said marking indicia appearing only on said upper faces.

5. Game apparatus according to claim 4 wherein each of said tiles is sufficiently thick so as to permit said tile to be easily balanced on edge.

6. Game apparatus according to claim 1 wherein the marking indicia is located on the legs of said tile.

* * * * *